United States Patent [19]

Cole et al.

[11] 4,259,126

[45] Mar. 31, 1981

[54] METHOD OF MAKING RAZOR BLADE STRIP FROM AUSTENITIC STEEL

[75] Inventors: William L. Cole, Camberley; Geoffrey Stott, Ruislip Manor; Humphrey G. Bowden, Twickenham, all of England

[73] Assignee: Wilkinson Sword Limited, Buckinhamshire, England

[21] Appl. No.: 75,550

[22] Filed: Sep. 14, 1979

[30] Foreign Application Priority Data

Oct. 19, 1978 [GB] United Kingdom ..... 41160/78

[51] Int. Cl.[3] ..... C21D 1/20; C21D 7/14

[52] U.S. Cl. ..... 148/12 E; 30/346.53; 30/346.54; 75/124; 75/128 T; 148/12.3; 148/12.4; 148/130

[58] Field of Search ..... 148/12 E, 130, 12.1, 148/136, 38, 12.4, 12.3; 75/128 T, 124; 30/346.5, 346.53, 346.54

[56] References Cited

U.S. PATENT DOCUMENTS

| | | | |
|---|---|---|---|
| 3,425,877 | 2/1969 | Deacon et al. | 148/12.4 |
| 3,469,972 | 1/1966 | Christer et al. | 75/126 |
| 3,723,195 | 3/1973 | Flaherty et al. | 148/12.4 |
| 3,917,492 | 11/1975 | Backman et al. | 148/12 E |
| 4,077,812 | 3/1978 | Tani | 148/12.4 |

FOREIGN PATENT DOCUMENTS

| | | | |
|---|---|---|---|
| 2812878 | 10/1978 | Fed. Rep. of Germany | 75/128 T |
| 1104932 | 3/1968 | United Kingdom | 148/12.4 |
| 2002815 | 2/1979 | United Kingdom | 148/12 E |

*Primary Examiner*—L. Dewayne Rutledge
*Assistant Examiner*—Upendra Roy

[57] ABSTRACT

This invention provides a steel alloy, for use for razor blades, the ranges of composition of which are given in the table below, the first column giving the maximum range for the alloy elements and impurities (the balance being iron), the second column giving a narrower preferred range, whilst the third column gives a particularly advantageous composition:

| Element | Maximum Range | Preferred Range | Example |
|---|---|---|---|
| Ni% | 15 to 25 | 17 to 22 | 20 |
| Cr% | 3 to 8 | 3.5 to 5 | 4 |
| Ti% | 2 to 5* | 3 to 4.5 | 4 |
| Al% | 1 to 5* | 2 to 4 | 3 |
| C% | less than 0.02 | 0.01 | 0.005 |
| Mn% | less than 0.2 | 0.1 | 0.05 |
| Si% | less than 0.2 | 0.1 | 0.05 |
| N% | less than 0.02 | 0.01 | 0.003 |
| P, S% | less than 0.02 | 0.01 | 0.005 |

*but Ti + Al should be less than 9%

9 Claims, No Drawings

METHOD OF MAKING RAZOR BLADE STRIP FROM AUSTENITIC STEEL

The invention further provides a method of manufacturing razor blade strip from an alloy having a composition within the above ranges, in which the alloy is hot forged to produce bar which is rolled, without prior cooling, to produce strip and is held at elevated temperature for a time sufficient to austenitise the structure, the strip is then quenched, descaled, and reduced to final thickness.

This invention relates to razor blades, to the compositions of steel alloys used for the razor blades, and to methods of manufacturing razor blade strip from such steel alloys.

Our British Pat. No. 1,104,932 describes compositions of steel alloys for use for razor blades, and methods of manufacturing razor blades from such compositions.

We have found that there are particular ranges of compositions which lie within the broader ranges disclosed in British Pat. No. 1,104,932 from which improved razor blades can be produced.

According to the present invention there is provided a steel alloy, for use for razor blades, whose composition is:

| | |
|---|---|
| Ni% | 15 to 25 |
| Cr% | 3 to 8 |
| Ti% | 2 to 5 |
| Al% | 1 to 5 |

with the total of titanium plus aluminium being less than 9%, the balance being iron and impurities, the level of impurities being such that:

| | |
|---|---|
| C% | less than 0.02 |
| Mn% | less than 0.2 |
| Si% | less than 0.2 |
| N% | less than 0.02 |
| P% | less than 0.02 |
| S% | less than 0.02 |

The invention also provides a steel alloy, for use for razor blades, whose composition is:

| | |
|---|---|
| Ni % | 17 to 22 |
| Cr % | 3.5 to 5 |
| Ti % | 3 to 4.5 |
| Al % | 2 to 4 |

the balance being iron and impurities, the level of impurities being such that:

| | |
|---|---|
| C % | less than 0.01 |
| Mn % | less than 0.1 |
| Si % | less than 0.1 |
| N % | less than 0.01 |
| P % | less than 0.01 |
| S % | less than 0.01 |

The invention further provides a steel alloy, for use for razor blades, whose composition is:

| | |
|---|---|
| Ni % | 20 |
| Cr % | 4 |

-continued

| | |
|---|---|
| Ti % | 4 |
| Al % | 3 |

the balance being iron and impurities, the level of impurities being such that:

| | |
|---|---|
| C % | less than 0.005 |
| Mn % | less than 0.05 |
| Si % | less than 0.05 |
| N % | less than 0.003 |
| P % | less than 0.005 |
| S % | less than 0.005 |

There is also provided by the invention a method of manufacturing razor blade strip from an alloy having a composition as aforesaid, in which the alloy is hot forged to produce bar which is rolled, without prior cooling, to produce strip and is held at elevated temperature for a time sufficient to austenitise the structure, the strip is then quenched, descaled, and reduced to final thickness. The ranges of compositions suitable for the present invention are given in the table below, the first column giving the maximum range for the alloying elements used (the balance being iron). The second column gives a narrower range which we have found to be preferred, whilst in the third column there is given one example of a composition which has been found to be particularly advantageous.

| Element | Maximum Range | Preferred Range | Example |
|---|---|---|---|
| Ni% | 15 to 25 | 17 to 22 | 20 |
| Cr% | 3 to 8 | 3.5 to 5 | 4 |
| Ti% | 2 to 5* | 3 to 4.5 | 4 |
| Al% | 1 to 5* | 2 to 4 | 3 |
| C% | less than 0.02 | 0.01 | 0.005 |
| Mn% | less than 0.2 | 0.1 | 0.05 |
| Si% | less than 0.2 | 0.1 | 0.05 |
| N% | less than 0.02 | 0.01 | 0.003 |
| P, S% | less than 0.02 | 0.01 | 0.005 |

*but Ti + Al should be less than 9%

The choice of percentages of the elements is determined from the following considerations. The lower level in chromium (3%, preferably 3.5%) is set by the need to have adequate corrosion resistance. The upper limit (8%, preferably 5%) is because strength of the alloy, and ease of fabrication, deteriorate as the chromium content is increased.

Nickel is necessary to enable the alloy to be made fully austenitic at high temperature; sufficient must be there to prevent the formation of δ-ferrite. An upper limit on the nickel content is set because nickel stabilises the austenite against transformation to martensite during cold working and essentially full transformation is required to obtain maximum strength. If a lower level of cold working than 90 to 99% is being used, then the nickel content should be somewhat reduced. Since chromium also stabilises the austenite against martensite transformation, the contents of nickel and chromium should be balanced so that the content of nickel plus chromium is preferably 22 to 26%.

Titanium and aluminium are the main hardening elements. The strength of the alloy decreases as they are reduced, which sets their lower limits. The alloys become difficult to hot work if the aluminium and titanium levels exceed the preferred ranges. This is thought to be due to the presence of intermetallic compounds which are not fully dissolved in the austenitic phase at high temperature, and which may cause fracture on hot working. The total content of aluminium plus titanium should be less than 9%.

It is important that the residual elements carbon, manganese, silicon, nitrogen, phosphorous and sulphur should be kept at a low level, in common with general practice with maraging steels. Carbon and nitrogen form hard soluble carbides and nitrides with the titanium and aluminium present in the steel resulting in poor ductility, which can result in fracture on processing, and poor strength which can give problems at the cutting edge forming stage. Phosphorus and sulphur should be kept at a low level for similar reasons.

Methods of manufacturing razor blade strip 0.1 mm thick from an alloy having the exemplified composition given in the third column of the table above, will now be described:

EXAMPLE I

The alloy is produced by vacuum melting to avoid contamination by residual elements and oxides, preferably using a two-stage process consisting of vacuum melting, followed by consumable arc re-melting which further reduces the proportion of non-metallic elements and reduces segregation. The alloy is homogenised at a temperature in the region of 1200° C. and is hot forged at this temperature to produce bar of 75 mm diameter. The bar is next rolled at this temperature to produce strip of 6.5 mm thickness and then held at 1200° C. for 15 minutes to austenitise the structure. The strip is quenched into water from the austenitising temperature and the scale removed. The strip is then reduced to its final thickness by cold rolling without intermediate annealing, giving an approximately 98.4% reduction in area. The strip can then be slit to a final width which is appropriate for the cutting-edge forming process. Prior to edge forming the strip is subjected to a hardening treatment as described below. The reduction to final dimensions takes place whilst the material is still relatively soft and prior to the hardening treatment.

EXAMPLE II

The process differs from Example I by the use, during reduction to final thickness, of intermediate anneals at temperatures of 1050° to 1200° C., to reduce the amount of cold reduction necessary. For example, an anneal could be given when the strip was at 1.0 mm thickness, the final cold reduction in area being 90%.

EXAMPLE III

The initial stages are the same as for Example I, but instead of hot rolling to form strip the bar is hot rolled at 1200° C. to 5.0 mm diameter rod. It is austenitised for 15 minutes at 1200° C. and water quenched. The scale is then removed. The rod is next cold drawn to 1.25 mm diameter, either with or without an intermediate anneal. The wire is then flattened by rolling to produce a strip of 2.0 mm width and 0.1 mm thickness, giving approximately 99% reduction in area if there is no intermediate anneal.

EXAMPLE IV

The initial stages are the same as for Example III, but the alloy is hot rolled to 15.0 mm diameter rod, austenitised for 20 minutes at 1200° C. and water quenched. After descaling the alloy is cold drawn to 5.0 mm diameter rod, annealed for 10 minutes at 1150° C. and water quenched. It is then cold drawn to 2.6 mm diameter wire and flattened to produce strip of 4.3 mm width and 0.1 mm thickness without further annealing.

The austenitising temperatures which may be used are higher than those contemplated in British Pat. No. 1,104,932 and may lie within the range of 1050° to 1250° C. with the lower limit preferably 1100° C. Another difference is the preferred use of quenching for reducing the likelihood of precipitates forming during cooling.

Conventional hardening of maraging steels is by ageing for one to two hours at 480° C. in an inert atmosphere. For an alloy having the composition given in the third column of the table above such a treatment produces a hardness of 850 to 900 VPN (Vicker's Pyramid Number) for strip rolled to 98% cold reduction in area, but the strip is relatively brittle. With the present invention a shorter time/higher temperature treatment is preferred to improve ductility and has economic advantages. With careful control of the time, a higher level of toughness can be achieved for a given hardness value. The exact time required to give optimum properties at a particular hardening temperature vary to some extent with the previous history of the strip, but will not exceed ten minutes. We have found that satisfactory hardening can be obtained in times of less than a minute at temperatures between 500° C. and 600° C., the required time at any temperature being about half the time taken to reach peak hardness.

Hardening may be effected by moving strip continuously through a treatment furnace with the time determined from the fact that as hardness increases the toughness (impact energy) decreases. For example a hardness of 850 VPN can be achieved with a toughness which is satisfactory for subsequent processing and use. It will be appreciated that the very short treatment times are economical by comparison with the much longer times customarily employed.

Short treatment times are less advantageous when the impurities (in the form of residual elements) are at a low level. Moreover, conventional hardening, as referred to above, may be used when peak hardness is desired to maximise strength.

What is claimed is:

1. A method of manufacturing razor blade strip, to a state at which it is ready for cutting-edge formation, from an alloy whose composition is

| | |
|---|---|
| Ni% | 15 to 25 |
| Cr% | 3 to 8 |
| Ti% | 2 to 5 |
| Al% | 1 to 5 |

with the total of titanium plus aluminium being less than 9%, the balance being iron and impurities, the level of impurities being such that:

| | |
|---|---|
| C% | less than 0.02 |
| Mn% | less than 0.2 |
| Si% | less than 0.2 |
| N% | less than 0.02 |
| P% | less than 0.02 |
| S% | less than 0.02 |

comprising the steps of hot forging the alloy to bar, rolling the bar to strip, without prior cooling, maintaining the strip at elevated temperature to austenitise the structure, quenching the strip, descaling the strip, reducing the strip to final thickness, and finally subjecting the strip to hardening at a temperature of between 500° and 600° C. for not more than ten minutes.

2. A method of manufacturing razor blade strip, to a state at which it is ready for cutting-edge formation, from an alloy whose composition is:

| | |
|---|---|
| Ni % | 20 |
| Cr % | 4 |
| Ti % | 4 |
| Al % | 3 |

the balance being iron and impurities, the level of impurities being such that:

| | |
|---|---|
| C % | less than 0.005 |
| Mn % | less than 0.05 |
| Si % | less than 0.05 |
| N % | less than 0.003 |
| P % | less than 0.005 |
| S % | less than 0.005 |

comprising the steps of hot forging the alloy to bar, rolling the bar to rod, without prior cooling, maintaining the rod at elevated temperature to austenitise the structure, quenching the rod, descaling the rod, drawing down the rod to wire, rolling the wire to strip, and finally subjecting the strip to hardening at a temperature of between 500° and 600° C. for less than one minute.

3. A method according to either claim 1 or claim 2, in which the alloy is produced by vacuum melting.

4. A method according to either claim 1 or claim 2, in which the alloy is produced by vacuum melting followed by consumable arc re-melting.

5. A method according to either claim 1 or claim 2, in which the alloy is homogenised at elevated temperature in the region of 1200° C.

6. A method according to either claim 1 or claim 2, in which the alloy is hot forged at a temperature in the region of 1200° C.

7. A method according to claim 1 or claim 2, in which during reduction to final thickness the material is subjected to intermediate anneals at temperatures in the range 1050° to 1250° C.

8. A method of manufacturing razor blade strip, to a state at which it is ready for cutting-edge formation, from an alloy whose composition is:

| | |
|---|---|
| Ni % | 20 |

-continued

| | |
|---|---|
| Cr % | 4 |
| Ti % | 4 |
| Al % | 3 |

the balance being iron and impurities, the level of impurities being such that

| | |
|---|---|
| C % | less than 0.005 |
| Mn % | less than 0.05 |
| Si % | less than 0.05 |
| N % | less than 0.003 |
| P % | less than 0.005 |
| S % | less than 0.005 |

comprising the steps of hot forging the alloy to bar at a temperature in the region of 1200° C., rolling the bar to strip, without prior cooling, maintaining the strip at elevated temperature to austenitise the structure, quenching the strip, descaling the strip, reducing the strip to final thickness whilst subjecting the strip during the reduction process to intermediate anneals at temperatures in the range 1050° to 1250° C., and finally subjecting the strip to hardening at a temperature of between 500° and 600° C. for less than one minute.

9. A method of manufacturing razor blade strip, to a state at which it is ready for cutting-edge formation, from an alloy whose composition is:

| | |
|---|---|
| Ni % | 17 to 22 |
| Cr % | 3.5 to 5 |
| Ti % | 3 to 4.5 |
| Al % | 2 to 4 |

the total of nickel plus chromium being from 22 to 26%, the balance being iron and impurities, the level of impurities being such that:

| | |
|---|---|
| C % | less than 0.01 |
| Mn % | less than 0.1 |
| Si % | less than 0.1 |
| N % | less than 0.01 |
| P % | less than 0.01 |
| S % | less than 0.01 |

comprising the steps of hot forging the alloy to bar, rolling the bar to rod, without prior cooling, maintaining the rod at elevated temperature to austenitise the structure, quenching the rod, descaling the rod, drawing down the rod to wire, rolling the wire to strip, and finally subjecting the strip to hardening at a temperature of between 500° and 600° C. for less than one minute.

* * * * *